United States Patent [19]

Mansfield et al.

[11] 4,059,085

[45] Nov. 22, 1977

[54] ENGINE STRUCTURE

[75] Inventors: Wilfred Percival Mansfield, Eastleigh; Theodor Priede, Southampton, both of England

[73] Assignee: National Research Development Corporation, London, England

[21] Appl. No.: 680,677

[22] Filed: Apr. 27, 1976

[51] Int. Cl.[2] ..... F02F 7/00

[52] U.S. Cl. ..... 123/195 R

[58] Field of Search ..... 123/195 R, 195 H

[56] References Cited

U.S. PATENT DOCUMENTS

| | | | |
|---|---|---|---|
| 1,971,673 | 8/1934 | Atteslander | 123/195 R X |
| 1,972,752 | 9/1934 | Balough | 123/195 R |
| 3,977,385 | 8/1976 | Mansfield | 123/195 R |

FOREIGN PATENT DOCUMENTS

| | | | |
|---|---|---|---|
| 637,372 | 10/1936 | Germany | 123/195 R |

*Primary Examiner*—Alan Cohan

*Attorney, Agent, or Firm*—Cushman, Darby & Cushman

[57] ABSTRACT

An internal combustion engine structure in which the cylinder head and main bearing caps are linked by a framework of members including pairs of tension members each angled obliquely to the direct line between head and caps. The members of the framework are arranged so as to bear a substantial proportion of the firing loads of the engine in tension or compression without bending, thus relieving other parts of the engine, especially its outer surfaces, from loads under which they would tend to bend and thus emit noise. The framework may also serve to strengthen parts of the engine wall to make it less susceptible to bending.

11 Claims, 6 Drawing Figures

ENGINE STRUCTURE

This invention relates to engine structures. In particular it relates to the structure of internal combustion reciprocating engines especially diesel engines.

In such engines a common plane including the crankshaft axis and the axis of a cylinder will be referred to as the central plane of that cylinder. Such engines must possess the strength to prevent the loads set up by the firings of the cylinders from forcing the cylinder head and main bearing caps apart in opposite directions, each lying in the central plane. The cylinder walls themselves form a link between the head and the main bearings and inevitably contribute some of the strength to resist this separation load, but other structures are needed also.

This invention is concerned with such structures mounted to one side of the central plane, and preferably one to each side of that plane. In many known designs of engine the structures which serve this purpose are the conventional water jackets, air sheets etc. that surround the cylinders. Although such structures are designed to withstand the loads to which they are subjected, their shape and construction is frequently such that they bend when subjected to the loads, with consequent vibration and noise. Such noise is caused not only by the effect upon them of the main components of the firing loads, acting in directions substantially parallel to the cylinder axes, but also of secondary load components acting upon them particularly where they connect to the main bearings and in a lateral direction, i.e. at right angles to the cylinder axes. These secondary load components arise from the fact that the connecting rods lie oblique to the cylinder axes during much of the engine cycle.

It should be noted that load-bearing structures have been proposed, for instance in U.K. patent applications No. 58491/73 cognate 26071/74, that would connect the cylinder head and main bearing housings in a more direct manner less liable to vibration, but such structures are not practicable in some engines where their presence would conflict with other essential structures. There have also been many proposals for strengthening an engine by adding straight-through bolts lying parallel to the axes of the cylinders, one end of these bolts being secured to the cylinder head structure and the other end sometimes to the main bearing caps and sometimes to some other low point in the engine structure, for instance to the sump casing. In so far as such prior art discloses bolts running between the cylinder head structure and the main bearing caps the present invention differs from it in providing a linkage between head and caps that does not run in a straight line, and which may therefore be used in the frequent cases where other essential features of the engine prevent a straight-line link.

As defined by the claims at the end of this specification, the present invention includes links strong in tension, some connected to the cylinder head structure and others to the main bearings, particularly the main bearing caps. By such use of the word "connected" we mean connections such that a substantial proportion of the forces necessary to resist separation of head and bearings by the engine firing forces will come to be exerted by the tension members in question. Thus if the cylinder head should be integral with the cylinder bores or other parts of the engine structure then the tension members connected to the head should be for instance be bolted or clamped to, or cast integrally with, the head part of the structure itself. In the more common case where the cylinder head structure is held by studs to the main body of the engine, then the upper ends of the tension links may be similarly attached to that body, preferably adjacent the stud recesses, so that the necessary restraining forces may be transmitted as directly as possible from the tension links through the studs to the head. At the other end of the engine the other tension links should likewise be connected to the cap parts of the main bearings so that a substantial proportion of the oppositely-directed force exerted upon those cap parts by the engine firings is resisted by these other tension links. In the typical case where the main bearing halves are integral with the principal engine castings, and where the caps are secured to the halves by studs, the tension links may thus be integral with the principal casting or bolted or otherwise secured to it so that the line of action of a tension link is directed closely towards the studs. If bearing halves and caps are secured by more than one diametrically-opposed pair of studs then the tension links should be aligned with the main load-bearing pair, usually the pair closest to the bearing shaft.

The invention is defined by the claims at the end of this specification and will now be described, by way of example, with reference to the accompanying drawings of parts of a two-stroke diesel internal combustion engine in which:

Figure 1:
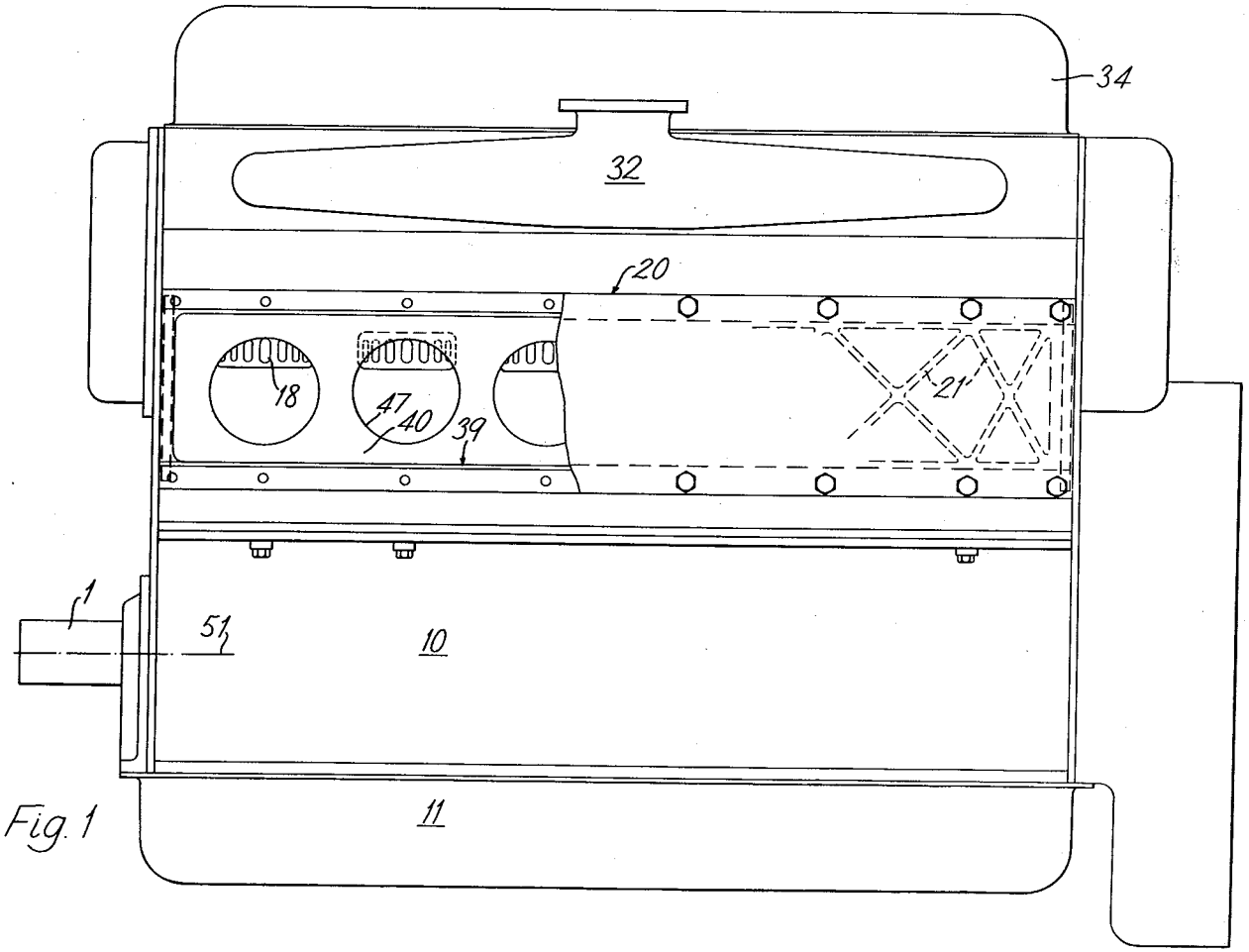
FIG. 1 is a side elevation partly cut-away.

The drawings show an engine with a crankshaft 1 running in main bearings comprising housings 2 and caps 3, pistons 4, connecting rods 5 and cylinders with bore liners 6, and a cylinder head structure 7. The drawings also show a flywheel housing 9, crankcase 10, sump 11 and main bearing studs 12. In the middle region of the engine the cylinder walls are surrounded by water cooling passages 13, 14. A blower 15 delivers charging air to an air chest 16 which communicates with the cylinder bores through air ports 17 and 18 which are uncovered when pistons 4 approach the bottom end of their stroke. On the side of the engine opposite blower 15, chest 16 is sealed by a cover plate 20 with reinforcing ribs 21 and mounted on a soft joint 19.

At the upper end of the engine a cam shaft 22 drives push rods 23 operating rocker arms 24 mounted on a pivot 25 and controlling the movements of a spring-loaded injector mechanism 26 and spring-loaded exhaust valves 27 with valve heads 28. Exhaust passages 29 controlled by heads 28 pass through a water cooling duct 30 discharging into water manifold 31, and thence to an exhaust manifold 32. Cylinder head structure 7 is secured by studs 33 and the rocker arms 24 and associated parts are enclosed by a cover 34. The central plane of the engine, which includes the axes of the individual cylinders and the axis of crankshaft 1, is represented by reference 35.

The invention comprises a linkage notably free from bending moments, yet able to resist the tendency of the main components of the engine firing loads to separate the cylinder head structure 7 from the main bearing caps 3, and the tendency of secondary lateral components, acting particularly upon the main bearings, to cause lateral movements. At each side of the engine the linkage comprises upper links 40, strong in tension, and lower links 41, similarly strong. Links 40 are in the form of flat panels cast integrally with the main body of the engine; at their upper ends 42 they diverge from the rest of the principal engine casting of the engine body 43; it will be seen that ends 42 lie close to the points at which studs 33 engage with body 43 to attach head structure 7 to it. At their lower ends 39 the upper links 40 merge into cast intermediate member 46. Between their two ends the links 40 are formed with apertures 47 which serve both to reduce weight and to prevent the members from interfering with the passage of the charging air.

The lower tension links 41 of the linkage are also in the form of cast panels merging at their lower ends 44 with the main bearing housings 2 close to the points where they receive studs 12. Like links 40, links 41 are also angled obliquely to the direct line between the head and caps and for the even distribution of load between 40 and 41 it is preferable that the angles of obliquity should be nearly equal or at least similar. At their upper ends 45 the lower links 41 merge, like the upper links 40, with members 46. Links 41 are formed with apertures 50, which may for example be of semi-circular shape, to accommodate the throws of crankshaft 1 as it rotates about its axis 51.

When a cylinder fires, generating a load tending to separate head structure 7 from principal engine body casting 43 in one direction along the axis of that cylinder, and main bearing cap 3 from it in the opposite direction, the load is carried partly along the direct line (52) joining the head and caps and partly by the links 40, 41 and the intermediate members 46 at each side of the engine. The behaviour of links and members approximates to that of a chain of straight rods, with pivotted joints at each end of each of the rods. Since upper and lower links 40 and 41 both slope outwardly away from the main engine body casting 43, so that members 46 lie transversely well outward of the engine body relative to ends 42 and 44, a load that tends to separate head 7 and caps 3 and thus to elongate the main body of the engine, tends to flatten the trapezoidal shape of the chains so that member 46 approaches closer to line 52. The tendency is resisted, and the engine thus stabilised against elongation, by transverse members strong in compression, joining vertices of the linkage at one side of the engine to corresponding vertices at the other. In the drawing the vertices where the upper ends of lower links 41 meet the lower edge of members 46 are joined by a transverse member comprising the principal lower deck 53 of the engine. The vertices where the lower ends 39 of upper links 40 meet the upper edge of 46 are joined by a second deck-like member 54, parallel to and slightly above the deck 53.

Figure 4:
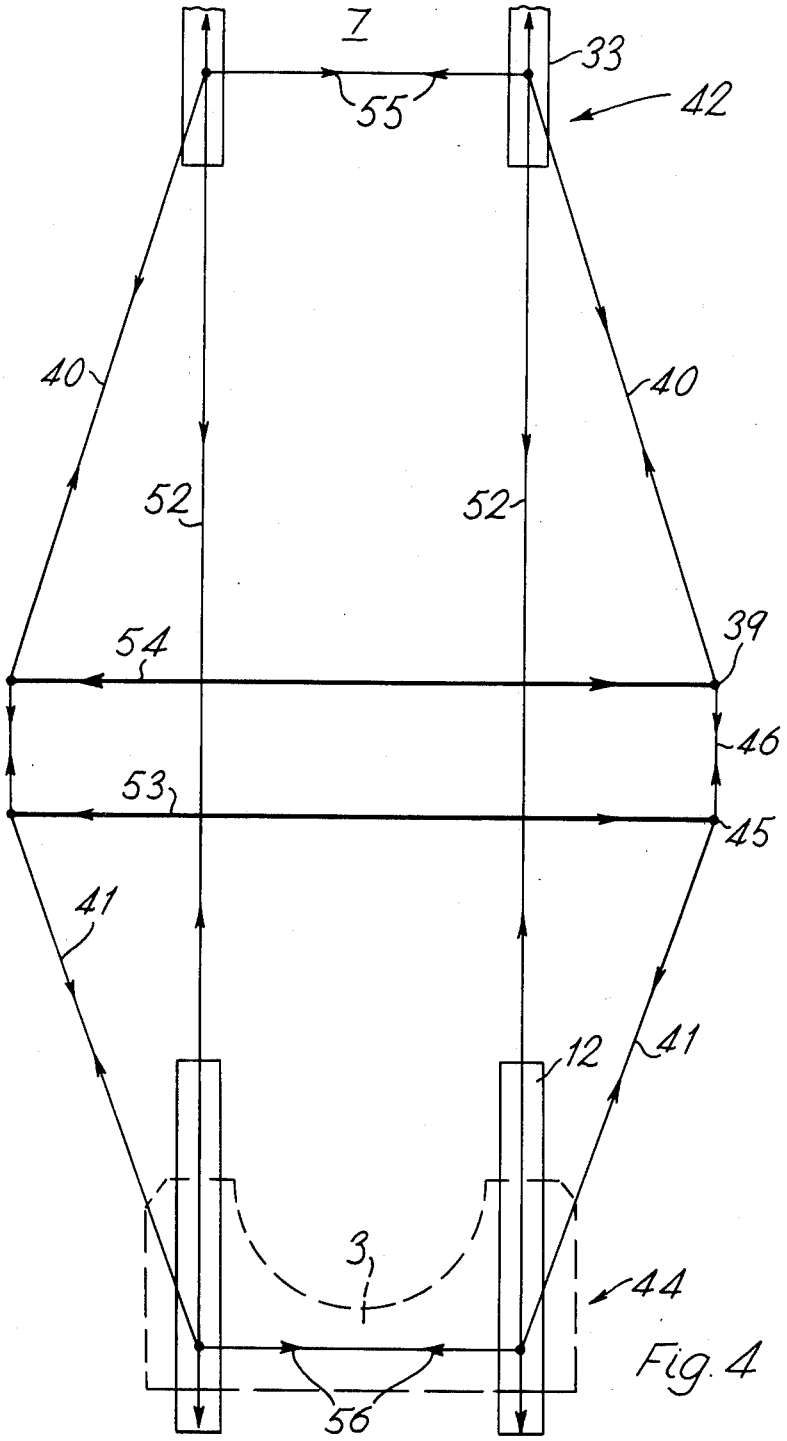
FIG. 4 is a force diagram relating to the same engine.

FIG. 4 shows diagrammatically the nature of the ideal forces set up in the complete load-bearing and anti-vibration framework, comprising members 40, 41, 46, 52, 53 and 54, by the firing of a cylinder. As can be seen, members 40, 41 and 46 are in pure tension, as is the structure lying along the direct lines 52 between studs 12 and 33; decks 53 and 54 are in transverse compression. The balance of forces is completed by forces 55, 56 acting transversely across the structure of the head and caps. Without links 40 and 41, the parts of the wall and other structure of the engine body lying along lines 52 would have to bear most of the load set up by the engine firing forces. This part of the engine structure is of course both integral with and close to many other parts of the structure of irregular shape including, for instance, the cooling passages 13, 14 and the housing for cam shaft 22. Thus when a heavy load is set up along line 52, it is likely to cause bending within many such parts with consequent noise. With the linkage of the present invention as shown in FIG. 4, most of the load will be taken by straight links 40, 41 in tension without bending, by intermediate members 46 which are short and robust and basically in tension also, and in compression by robust decks 53 and 54; the proportion of the load taken along lines 52 is thus diminished greatly, as is the amount of bending and the noise set up by it. In a simpler alternative design in which members 46 are omitted, the lower ends 39 of upper links 40 make a direct vertex and joint with the upper ends 45 of lower links 41 on each side of the engine. This vertex conveniently coincides with the rim of lower deck 53 which may then serve as the sole transverse compression member, second deck 54 being omitted.

Figure 5:
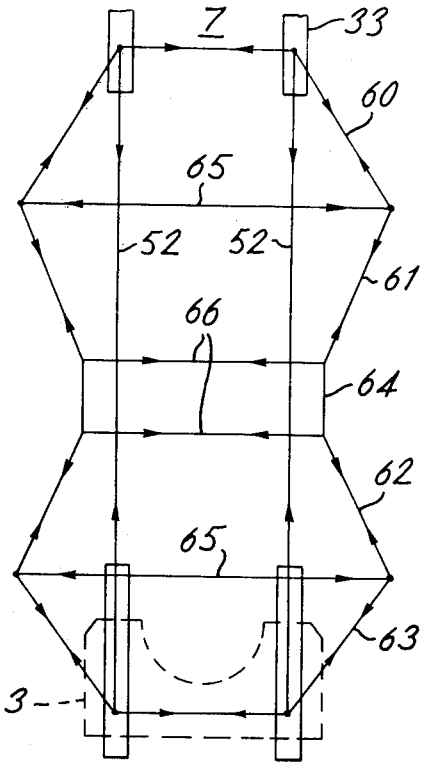
FIGS. 5 and 6 are force diagrams relating to alternative engines.

In the alternative and more complex construction according to the invention shown in FIG. 5 there are two pairs of links 60, 61 and 62, 63 to each side of the engine body, the two pairs on each side being linked in the middle by an intermediate member 64. This construction requires two transverse decks or other members 65 in compression, and two more (66) in tension, but the principle of operation remains the same, much of the firing load being taken in tension without bending by links 60, 61, 64 and 66 in compression by robust members 65, thus diminishing the load that has to be taken along lines 52 with consequent risk of engine bending and noise.

Figure 6:
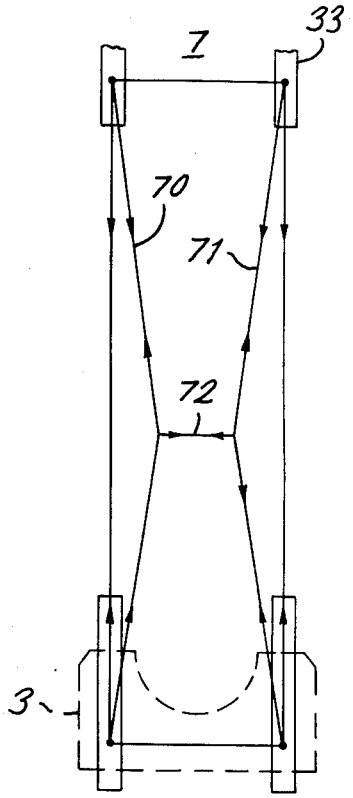

The principles of the invention also apply to designs of framework as shown in FIG. 6 in which the principal links 70, 71, while directing their line of force through the cylinder head and main bearing cap connections respectively, slope inwards rather than outwards away from lines 52. In such a case the transverse deck 72 would be in tension like decks 66 of FIG. 5, and of course the construction of the engine would have to allow clearance (e.g. between adjacent cylinders) for links 70, 71.

Other variations are of course possible without departing from the scope of the present invention. For instance while the tension links of the examples already described have all been as long as the engine itself when viewed in a direction running parallel to the crankshaft axis, and while the engines have had a unitary cylinder head structure including the heads of all the individual cylinders, it is of course possible especially in engines with many cylinders arranged in line that there could instead be many pairs of individual links, each pair linking an individual cylinder head to an individual main bearing cap or perhaps to the caps of the two main bearings one to either side of the cylinder concerned. It is also possible that more than one pair of links could be mounted in parallel over the same span; for instance, in FIG. 2 references 42 and 44 might serve not only as the points where the illustrated linkage 40, 41 is attached to the engine body, but they might in addition be the points of attachment of a second linkage, in parallel and more transversely outward, requiring decks 53, 54 to be extended outwardly to support its vertex. The invention could also apply to engines in which the essential linkage or linkages are used on one side of the engine body only; in such a case the other side of the engine would of course have to have balanced characteristics for the engine to run truly, but these similar characteristics might be achieved in different ways.

As described the essential links of this invention lie obliquely to the direct line between the cylinder head structure and the main bearings. They will thus usually tend to lie obliquely to the axes of the cylinders also, and a consequence of this is that the length-wise tension loads set up in the links have a useful component that helps to resist not only the firing loads already described but also the transverse forces that are applied to the main bearings during much of the engine cycle due to the obliquity of the connecting rods linking the pistons to the cranks of the crankshaft.

In an engine in which the framework contributes thus to transverse stabilisation of the main bearings, it may be possible to support the main bearing housings from the lower deck alone, without the customary direct connection — for instance, by way of cast transverse webs — with the walls of the crankcase. It may thus be more practicable to mount the crankcase as a separate unstressed unit attached only flexibly (e.g. by way of the resilient gasket 73, FIG. 2) to the rest of the engine structure, for example to the underside of the lower deck. The crankcase should thus be less prone to vibration than normal.

A further advantage of the invention results from the evidently triangular shape that the essential linkages often form with the engine body, and the extra stiffness and resistance to bending that such "triangulation" gives to parts of the engine body structure. Thus in FIGS. 2 and 3 the regions of the engine casting 43 lying close to the lines 52 on either side of the engine body each in effect form one side of a triangle of which the other two sides are the links 40 and 41 to that same side of the engine, and this triangulation tends to stiffen those lengths of engine wall against bending in response to forces acting in the region of studs 33 and 12, which is of course where the engine firing forces tend to act. It will be appreciated that this triangulation will only exist if the engine wall is continuous between studs 33 and 12; if it is interrupted, e.g. to make way for other essential parts of the engine so that the wall makes a tortuous and not a straight-line connection between the top and bottom studs, then although a linkage according to the invention will relieve such a wall of much stress it will not stiffen it by triangulation.

Figure 2:
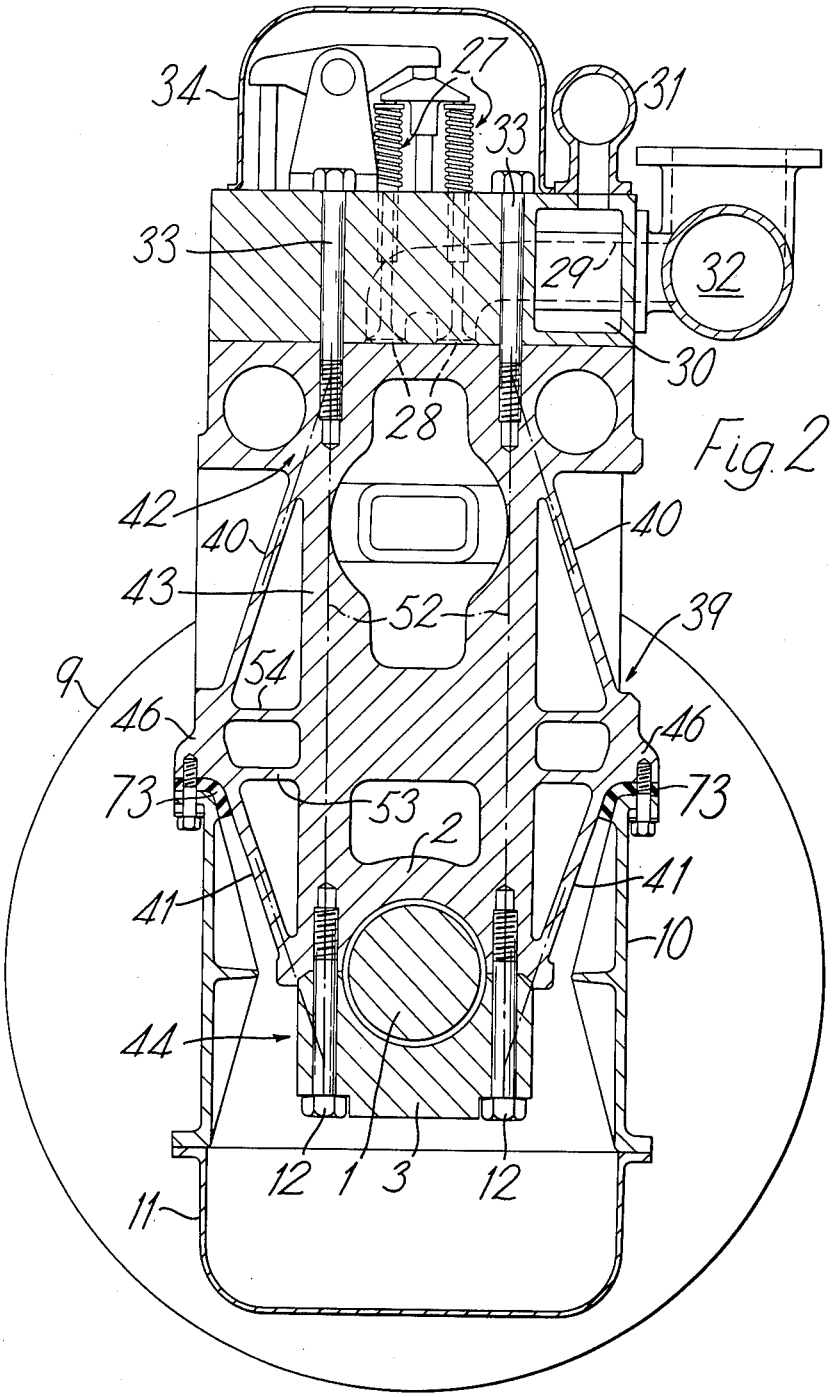
FIG. 2 is a transverse section, taken between cylinders.
Figure 3:
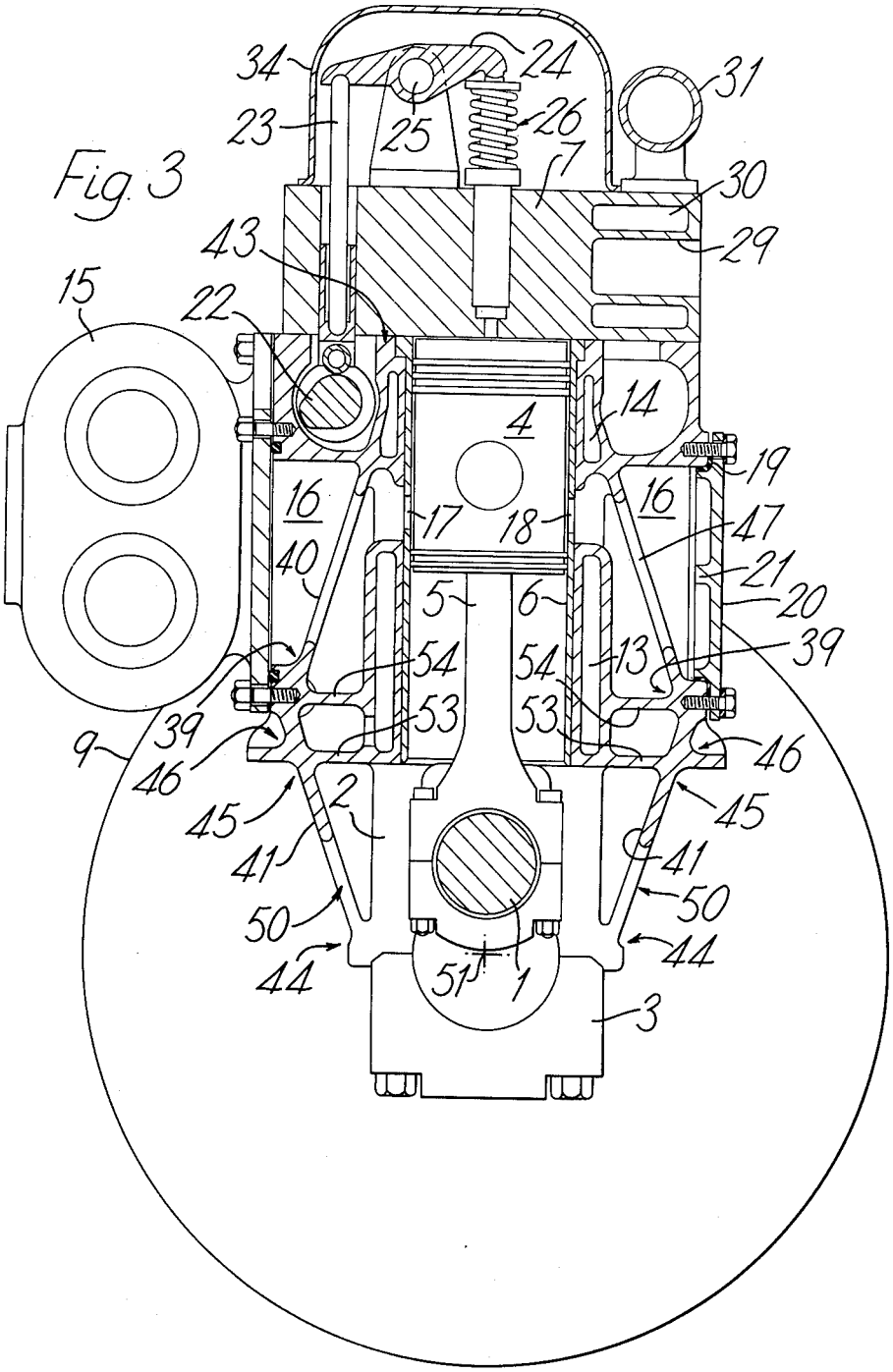
FIG. 3 is another transverse section, taken through a cylinder.

It should finally be noted that in the engine shown in FIGS. 1 to 3 the continuous air chest cover plate 20 replaces part of the side wall of a conventional engine, and is mounted on soft joints (19) in such a way as to ensure that unlike the normal wall it carries none of the firing load. Thus it does not deflect nor generate noise. The covers for blower 15 and adjacent parts may be similarly mounted. Substantially all the loads conventionally carried by the normal deflectable outer walls of an engine are carried in the engine described by the framework, of which outer members 40, 41 and 46 are in tension and not subject to bending. This has important consequences for the quietness of the engine, since vibration of the outer surfaces of engines accounts for much of their noise.

I claim:

1. An internal combustion engine having an engine body including:

a cylinder structure including cylinders;

a cylinder head structure;

main bearings;

said cylinder structure having parts constituting a first direct load-bearing linkage between said cylinder head structure and said main bearings, whereby to resist without bending the load set up by the firing forces in said cylinders and rending to separate said cylinder head structure and said main bearings;

a crankshaft lying lengthwise of said engine body and supported by said main bearings, and a second direct load-bearing linkage to afford further resistance to the separation of said cylinder head structure from said main bearings by the firing forces set up in said cylinders, in which said second linkage comprises at least one pair of straight-line links, strong in tension;

a first connection between a first end of a first said link of said pair and said cylinder head structure;

a second connection between a first end of a second said link of said pair and said main bearings;

both said links are angled obliquely to the direct line lying between said first and second connections and to each other, so that unobstructed space is left between said links and said direct line, said first and second ends of each said link thus being transversely spaced from each other;

a third connection is provided between said second ends of said first and second links, and a stabilising member supports said third connection and stabilises it against movement transverse relative to said engine body.

2. An internal combustion engine according to claim 1, in which said second ends of at least one pair of said links meet directly at a vertex.

3. An internal combustion engine according to claim 1 having an intermediate member by which said second ends of at least one pair of said links are connected.

4. An internal combustion engine according to claim 1 in which said links of said pair are angled so that said second ends of said links lie transversely more outward relative to said engine body than do said first ends of said links.

5. An internal combustion engine according to claim 4 in which said stabilising member is strong in compression and is supported from said engine body.

6. An internal combustion engine according to claim 1 having at least two pairs of links, arranged with one of said pairs to each side of said engine body.

7. An internal combustion engine according to claim 6 in which said stabilising member extends to both sides of said engine body and supports and stabilises both of said connecting members.

8. An internal combustion engine according to claim 7 having a cylinder block structure in which said cylinders are included, and in which said stabilising member serves also as a lower deck of said cylinder block structure.

9. An internal combustion engine according to claim 1 in which said main bearings comprise halves and caps and in which said first end of said second link of said pair of links is connected to the said cap of its said main bearing.

10. An internal combustion engine according to claim 1 in which said first ends of said pair of links are so located to the wall of said engine body that said two links and the part of said wall of said engine body lying between said locations form a triangulated structure, thus stabilising said part of said wall against bending.

11. An internal combustion engine according to claim 1 in which said cylinder structure includes parts extra to said first and second load-bearing linkages, said extra parts lying out of the direct line between said cylinder head structure and said main bearings and thus being liable to bending if subjected to said load set up by said firing forces, but being soft-mounted to avoid subjection to such loads.

* * * * *

UNITED STATES PATENT OFFICE

CERTIFICATE OF CORRECTION

Patent No. 4,059,085 Dated November 22, 1977

Inventor(s) Wilfred Percival Mansfield and Theodor Priede

It is certified that error appears in the above-identified patent and that said Letters Patent are hereby corrected as shown below:

Please correct the priority information to read as follows:

--UKPA No. 17577/75, filed April 28, 1975--

Claim 1, Column 6, line 8, change "rending" to --tending--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*